US011072454B2

(12) United States Patent
Wada et al.

(10) Patent No.: US 11,072,454 B2
(45) Date of Patent: Jul. 27, 2021

(54) LIQUID PAPER CONTAINER

(71) Applicant: NIPPON PAPER INDUSTRIES CO., LTD., Tokyo (JP)

(72) Inventors: Tatsuo Wada, Tokyo (JP); Kazuhiko Sase, Tokyo (JP); Takashi Omori, Tokyo (JP); Yukihiro Tanaka, Tokyo (JP); Eiichi Asoi, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 16/648,341

(22) PCT Filed: Sep. 19, 2018

(86) PCT No.: PCT/JP2018/034536
§ 371 (c)(1),
(2) Date: Mar. 18, 2020

(87) PCT Pub. No.: WO2019/059199
PCT Pub. Date: Mar. 28, 2019

(65) Prior Publication Data

US 2020/0216214 A1 Jul. 9, 2020

(30) Foreign Application Priority Data

Sep. 25, 2017 (JP) ..... JP2017-183729

(51) Int. Cl.
*B65D 5/40* (2006.01)
*B65D 5/06* (2006.01)
(Continued)

(52) U.S. Cl.
CPC ..... *B65D 5/40* (2013.01); *B31B 50/0044* (2017.08); *B31B 50/25* (2017.08); *B31B 50/747* (2017.08);
(Continued)

(58) Field of Classification Search
CPC ..... B65D 5/40; B65D 5/067; B65D 5/4266; B65D 5/563; B65D 5/62; B65D 5/029;
(Continued)

(56) References Cited

U.S. PATENT DOCUMENTS 8,814,034 B2 * 8/2014 Dickie ..... B65D 5/746 229/117.01
D845,124 S * 4/2019 Franic ..... D9/434
(Continued)

FOREIGN PATENT DOCUMENTS

JP 2011-173642 9/2011
JP 2013-241217 12/2013

OTHER PUBLICATIONS

International Search Report dated Dec. 11, 2018 in International (PCT) Application No. PCT/JP2018/034536.

*Primary Examiner* — Christopher R Demeree
(74) *Attorney, Agent, or Firm* — Wenderoth, Lind & Ponack, L.L.P.

(57) ABSTRACT

A liquid paper container capable of preventing leakage of a liquid and intrusion of, for example, air into the container through a gap between a part of a corresponding one of top-portion horizontal folding creases formed in a blank sheet and a top-portion horizontal folding crease formed in a side sealing panel, which overlap with each other, top panels (11, 12) and side panels (15, 16) are respectively contiguous with upper ends of body panels through top-portion horizontal folding creases (9, 10, 13, 14). Bottom panels (21, 22) and inner panels (25, 26) are respectively contiguous with lower ends of the body panels through bottom-portion horizontal folding creases (19, 20, 23, 24). A side sealing panel (30) is contiguous with a one-side open end edge of a blank sheet (1A). A top-portion horizontal
(Continued)

folding crease (31) and a bottom-portion horizontal folding crease (32) are formed in the side sealing panel.

15 Claims, 6 Drawing Sheets

(51) Int. Cl.

| | |
|---|---|
| ***B65D 5/42*** | (2006.01) |
| ***B65D 5/56*** | (2006.01) |
| ***B65D 5/62*** | (2006.01) |
| ***B31B 50/74*** | (2017.01) |
| ***B31B 50/25*** | (2017.01) |
| ***B31B 50/00*** | (2017.01) |

(52) U.S. Cl.
CPC ..... *B65D 5/067* (2013.01); *B65D 5/4266* (2013.01); *B65D 5/563* (2013.01); *B65D 5/62* (2013.01)

(58) Field of Classification Search
CPC ..... B65D 5/064; B31B 50/747; B31B 50/25; B31B 50/0044
USPC ..... 229/125.42, 137, 184; 220/677
See application file for complete search history.

(56) References Cited

U.S. PATENT DOCUMENTS

| | | | | |
|---|---|---|---|---|
| D877,615 | S * | 3/2020 | Franic | D9/433 |
| D881,695 | S * | 4/2020 | Luik | D9/431 |
| 10,815,025 | B2 * | 10/2020 | Kalberer | B65D 5/4266 |
| 10,850,887 | B2 * | 12/2020 | Dammers | B65D 5/029 |
| 2011/0113733 | A1 | 5/2011 | Franic | |

* cited by examiner

LIQUID PAPER CONTAINER

TECHNICAL FIELD

The present invention relates to a liquid paper container having a flat top-type top portion (including a brick-type paper container) and a liquid paper container having a gable top-type top portion, which are configured to store a liquid beverage such as milk or juice.

BACKGROUND ART

Hitherto, a flat top-type liquid paper container and a gable top-type liquid paper container having the following structure have been widely used. Those liquid paper containers are each formed from a blank sheet made of a paper material having a thermoplastic resin laminated on each of a front surface and a back surface of the paper material. The blank sheet includes four body panels, a pair of top panels, a pair of side panels, sealing panels, a pair of bottom panels, and a pair of inner panels. The four body panels are contiguous through body vertical folding creases. The pair of top panels and the pair of side panels are respectively contiguous with upper ends of the body panels through top-portion horizontal folding creases so that the pair of top panels are opposed to each other and the pair of side panels are each positioned between the pair of top panels and are opposed to each other. The sealing panels are contiguous with upper ends of the top panels and upper ends of the side panels through sealing-portion horizontal folding creases. The pair of bottom panels and the pair of inner panels are respectively contiguous with lower ends of the body panels through bottom-portion horizontal folding creases so that the pair of bottom panels are opposed to each other and the pair of inner panels are each positioned between the pair of bottom panels and are opposed to each other. Aside sealing panel is contiguous with a one-side open end edge of the blank sheet through a vertical folding crease at a boundary of the side sealing panel. The side sealing panel has a top-portion horizontal folding crease of the side sealing panel, which is to be overlapped with a corresponding one of the top-portion horizontal folding creases at time of sealing, and a bottom-portion horizontal folding crease of the side sealing panel, which is to be overlapped with a corresponding one of the bottom-portion horizontal folding creases at the time of sealing. The side sealing panel is sealed to an another-side open end edge of the blank sheet to form a body having a rectangular shape. The top panels and the side panels are folded inward, and the sealing panels are sealed to each other so as to be tightly closed to form a top portion. The bottom panels and the inner panels are folded inward and sealed so as to be tightly closed to form a bottom portion.

In the liquid paper container formed in the above-mentioned manner, the body having a tubular shape is formed by sealing the side sealing panel to the another-side open end edge of the blank sheet. At the time of sealing of the side sealing panel, when the side sealing panel is overlapped with the another-side open end edge of the blank sheet, the top-portion horizontal folding crease of the blank sheet and the top-portion horizontal folding crease of the side sealing panel overlap with each other, and the bottom-portion horizontal folding crease of the blank sheet and the bottom-portion horizontal folding crease of the side sealing panel overlap with each other.

Each of the top-portion horizontal folding crease and the top-portion horizontal folding crease of the side sealing panel is a pressed crease, which protrudes to a valley-folding side. Thus, a gap is formed between the top-portion horizontal folding crease and the top-portion horizontal folding crease of the side sealing panel, which overlap with each other. At the above-mentioned portion having the gap, heat transfer is lower than that through other sealing surfaces. Thus, it is difficult to completely eliminate the gap between the top-portion horizontal folding crease and the top-portion horizontal folding crease of the side sealing panel. As a result, the above-mentioned portion may inevitably become a weakly bonded portion. The same applies to a gap between the bottom-portion horizontal folding crease of the blank sheet and the bottom-portion horizontal folding crease of the side sealing panel.

In particular, at the top portion, each of angles formed by folding the pair of top panels and the pair of side panels along the top-portion horizontal folding creases and the top-portion horizontal folding crease of the side sealing panel is an inclination angle to which a deformation force is liable to be applied. Thus, a bonded portion corresponding to the top-portion horizontal folding crease of the side sealing panel and a part of a corresponding one of the top-portion horizontal folding creases, which are bonded to each other, is in an inclined and unstable state. Thus, the bonded portion is always subjected to the deformation force in a separating direction, and is liable to cause separation.

Thus, for example, during handling such as conveyance, when a strong pressing force or impact force is applied to the top portion, the separation may occur in the bonded portion. As a result, a liquid corresponding to a content may leak out through the gap between the part of the corresponding one of the top-portion horizontal folding crease and the top-portion horizontal folding crease of the side sealing panel. Further, even when the leakage does not occur, for example, air is more liable to intrude into the container due to change with time. As a result, bulge of the body may occur.

Hitherto, as a liquid paper container for solving the problems described above, there is disclosed a liquid paper container having horizontal-folding-crease absent portions (see, for example, Patent Literature 1). The side sealing panel has the top-portion horizontal folding crease of the side sealing panel and the bottom-portion horizontal folding crease of the side sealing panel. Each of the horizontal-folding-crease absent portions extends continuously to an end edge of the side sealing panel on the end edge side of the side sealing panel.

In the liquid paper container described in Patent Literature 1, the end edge of the side sealing panel having the horizontal-folding-crease absent portions on the end edge side is folded back by so-called skive hemming. When the side sealing panel is overlapped with the another-side open end edge of the blank sheet, the horizontal-folding-crease absent portion, which has a smooth surface, and a part of a corresponding one of the top-portion horizontal folding creases of the blank sheet, which is formed so as to be pressed into a protruding shape, overlap with each other. As a result, a gap formed therebetween is extremely small. Thus, a perfect bonding state can be obtained, and leakage of the liquid to an outside through the gap between the top-portion horizontal-folding-crease absent portion of the side sealing panel and the part of the corresponding top-portion horizontal folding crease of the blank sheet, which overlap with each other, can be prevented.

CITATION LIST

Patent Literature

[PTL 1] JP 3-29422 A

SUMMARY OF INVENTION

Technical Problem

With the paper container described in Patent Literature 1, when the side sealing panel is overlapped with the another-side open end edge of the blank sheet, the horizontal-folding-crease absent portion of the side sealing panel, which has a smooth surface, and the part of the corresponding top-portion horizontal folding crease of the blank sheet, which is pressed into the protruding shape, overlap with each other. Thus, the gap therebetween is extremely small, and a perfect bonding state is obtained. As long as the bonding state is kept perfect, the leakage of a liquid to the outside through the gap between the horizontal-folding-crease absent portion of the side sealing panel and the part of the top-portion horizontal folding crease of the blank sheet, which overlap with each other, can be prevented.

At the time of forming the top portion, however, when the pair of top panels and the pair of side panels are folded inward along the top-portion horizontal folding creases, the top-portion horizontal folding crease of the side sealing panel, which may allow easy horizontal folding, is not formed in the side sealing panel so that the top-portion horizontal-folding-crease absent portion extends to the end edge of the side sealing panel. Thus, smooth inward folding at the top-portion horizontal-folding-crease absent portion of the side sealing panel becomes difficult. As a result, not only a sharp corner cannot be obtained, but also the following problems may occur. Specifically, when the side sealing panel is forced to be folded inward at the top-portion horizontal-folding-crease absent portion, a wrinkle may be formed in the top-portion horizontal-folding-crease absent portion of the side sealing panel to cause separation from the top-portion horizontal folding crease, to which the top-portion horizontal-folding-crease absent portion is bonded. As a result, a liquid may leak out through the gap formed by the separation. Even when the leakage does not occur, for example, air is more liable to intrude into the container due to change with time. As a result, bulge of the body may occur.

An object of the present invention is to provide a liquid paper container, with which a pair of top panels and a pair of side panels can easily be folded inward, especially, at time of forming a top portion, and leakage of a liquid and intrusion of, for example, air into the container through a gap between apart of a corresponding one of top-portion horizontal folding creases formed in a blank sheet and a top-portion horizontal folding crease formed in a side sealing panel, which overlap with each other and are sealed to each other, can be prevented.

Solution to Problem

In order to achieve the above-mentioned object, according to a first aspect of the invention, there is provided a liquid paper container, which is formed from a blank sheet made of a paper material having a thermoplastic resin laminated on each of a front surface and a back surface of the paper material, the blank sheet including: four body panels, which are contiguous through body vertical folding creases; a pair of top panels and a pair of side panels, which are respectively contiguous with upper ends of the body panels through top-portion horizontal folding creases so that the pair of top panels are opposed to each other and the pair of side panels are each positioned between the pair of top panels and are opposed to each other; sealing panels, which are respectively contiguous with upper ends of the top panels and upper ends of the side panels through sealing-portion horizontal folding creases; and a pair of bottom panels and a pair of inner panels, which are respectively contiguous with lower ends of the body panels through bottom-portion horizontal folding creases so that the pair of bottom panels are opposed to each other and the pair of inner panels are each positioned between the pair of bottom panels and are opposed to each other, the liquid paper container including: aside sealing panel, which is contiguous with a one-side open end edge of the blank sheet through a vertical folding crease at a boundary of the side sealing panel, the side sealing panel having a top-portion horizontal folding crease of the side sealing panel, which is to be overlapped with a corresponding one of the top-portion horizontal folding creases at time of sealing, and a bottom-portion horizontal folding crease of the side sealing panel, which is to be overlapped with a corresponding one of the bottom-portion horizontal folding creases at the time of sealing, wherein the side sealing panel is sealed to an another-side open end edge of the blank sheet to form a body having a rectangular shape, wherein the pair of top panels and the pair of side panels are folded inward and the sealing panels are sealed to each other so as to be tightly closed to form a top portion, wherein the pair of bottom panels and the pair of inner panels are folded inward and sealed so as to be tightly closed to form a bottom portion, and wherein a folding-crease absent portion is provided in midway of the top-portion horizontal folding crease of the side sealing panel, which is formed in the side sealing panel.

According to a second aspect of the invention, in the liquid paper container according to the first aspect, one of the side panels for forming the top portion and one of the inner panels for forming the bottom portion are located on the another-side open end side of the blank sheet, the side sealing panel has a top-portion diagonal folding crease of the side sealing panel, which is to be overlapped with a corresponding one of top-portion diagonal folding creases formed in the one side panel located on the another-side open end side of the blank sheet at the time of sealing, and the folding-crease absent portion is provided in midway of the top-portion diagonal folding crease of the side sealing panel.

According to a third aspect of the invention, in the liquid paper container of the first or second aspects, the side sealing panel has a sealing-portion horizontal folding crease of the side sealing panel, which is to be overlapped with a corresponding one of the sealing-portion horizontal folding creases at the time of sealing, and the folding-crease absent portion is provided in midway of the sealing-portion horizontal folding crease of the side sealing panel.

According to a fourth aspect of the invention, in the liquid paper container of any one of the first through third aspects, the folding-crease absent portion is provided in midway of the bottom-portion horizontal folding crease of the side sealing panel, which is formed in the side sealing panel.

According to a fifth aspect of the invention, in the liquid paper container of any one of the first through fourth aspects, one of the side panels for forming the top portion and one of the inner panels for forming the bottom portion are located on the another-side open end side of the blank sheet, the side sealing panel has a bottom-portion diagonal folding crease of the side sealing panel, which is to be overlapped with a corresponding one of bottom-portion diagonal folding creases formed in the one inner panel located on the another-side open end side of the blank sheet at the time of sealing, and the folding-crease absent portion is provided in midway of the bottom-portion diagonal folding crease of the side sealing panel.

According to a sixth aspect of the invention, in the liquid paper container of any one of the first through fifth aspects, the folding-crease absent portion includes a plurality of the folding-crease absent portions.

According to a seventh aspect of the invention, in the liquid paper container of any one of the first through sixth aspects, the folding-crease absent portion falls within a range of from 13% to 40% of a width of the side sealing panel.

Advantageous Effects of Invention

With the liquid paper container according to the first aspect of the invention, the folding-crease absent portion is provided in the midway of the top-portion horizontal folding crease of the side sealing panel, which is formed in the side sealing panel. Thus, at the time of sealing, a gap formed between a part of a corresponding one of the top-portion horizontal folding creases and the folding-crease absent portion, which overlap with each other, is extremely small. Thus, a far more perfect bonding state is obtained for bonding between the part of the corresponding top-portion horizontal folding crease and the folding-crease absent portion than for bonding between a part of the top-portion horizontal folding crease and the top-portion horizontal folding crease of the side sealing panel, which overlap with each other.

Thus, during handling such as conveyance, even when a strong pressing force or impact force is applied to the top portion to cause separation in a bonded portion corresponding to the part of the corresponding top-portion horizontal folding crease and the top-portion horizontal folding crease of the side sealing panel, which are bonded to each other, and a liquid content in the container flows out into the gap between the part of the corresponding top-portion horizontal folding crease and the top-portion horizontal folding crease of the side sealing panel, which is formed due to the separation occurring in the bonded portion, the bonded portion corresponding to the part of the corresponding top-portion horizontal folding crease and the folding-crease absent portion, which overlap with each other, serves as a weir to block the gap. As a result, the leakage of the liquid content to the outside of the container can be prevented. Further, even when the leakage does not occur, the bonded portion corresponding to the part of the corresponding top-portion horizontal folding crease and the folding-crease absent portion, which overlap with each other, blocks the gap to prevent the intrusion of, for example, air into the container through the gap between the corresponding top-portion horizontal folding crease and the top-portion horizontal folding crease of the side sealing panel. As a result, bulge of the body can be prevented.

Further, the folding-crease absent portion is provided in the midway of the top-portion horizontal folding crease of the side sealing panel. Thus, at the time of forming the top portion, when the top panels and the side panels are folded inward along the top-portion horizontal folding creases, horizontal folding along the part of the corresponding top-portion horizontal folding crease and the folding-crease absent portion, which overlap with each other, is guided from both sides in a horizontal folding direction by easily achievable horizontal folding along the corresponding top-portion horizontal folding crease and the top-portion horizontal folding crease of the side sealing panel, which overlap with each other. As a result, the side sealing panel is easily folded inward. Thus, the top panels and the side panels can easily be folded inward. As a result, the top portion can easily and reliably be formed, and sharp corners can be obtained.

With the liquid paper container according to the second aspect of the invention, the folding-crease absent portion is provided in the midway of the top-portion diagonal folding crease of the side sealing panel, which is formed in the side sealing panel. Thus, at the time of sealing, a gap formed between a part of the corresponding top-portion diagonal folding crease and the folding-crease absent portion provided in the midway of the top-portion diagonal folding crease of the side sealing panel, which overlap with each other, is extremely small. Thus, a far more perfect bonding state is obtained for bonding between the part of the corresponding top-portion diagonal folding crease and the folding-crease absent portion than for bonding between the part of the corresponding top-portion diagonal folding crease and the top-portion diagonal folding crease of the side sealing panel, which overlap with each other.

Thus, during handling such as conveyance, even when a strong pressing force or impact force is applied to the top portion to cause separation in a bonded portion corresponding to the part of the corresponding top-portion diagonal folding crease and the top-portion diagonal folding crease of the side sealing panel, which are bonded to each other, and a liquid content in the container flows out into the gap between the part of the corresponding top-portion diagonal folding crease and the top-portion diagonal folding crease of the side sealing panel, which is formed due to the separation occurring in the bonded portion, the bonded portion corresponding to the part of the corresponding top-portion diagonal folding crease and the folding-crease absent portion, which overlap with each other, serves as a weir to block the gap. As a result, the leakage of the liquid content to the outside of the container can be prevented. Further, even when the leakage does not occur, the bonded portion corresponding to the part of the corresponding top-portion diagonal folding crease and the folding-crease absent portion, which overlap with each other, blocks the gap to prevent the intrusion of, for example, air into the container through the gap between the corresponding top-portion diagonal folding crease and the top-portion diagonal folding crease of the side sealing panel. As a result, bulge of the body can be prevented.

Further, the folding-crease absent portion is provided in the midway of the top-portion diagonal folding crease of the side sealing panel. Thus, at the time of forming the top portion, when the side panels are folded inward along the top-portion diagonal folding creases, diagonal folding along the part of the corresponding top-portion diagonal folding crease and the folding-crease absent portion, which overlap with each other, is guided from both sides in a diagonal folding direction by easily achievable diagonal folding along the corresponding top-portion diagonal folding crease and the top-portion diagonal folding crease of the side sealing panel, which overlap with each other. As a result, the side sealing panel is easily folded inward. Thus, the top-portion diagonal folding crease can easily be folded inward. As a result, the top portion can easily and reliably be formed, and sharp corners can be obtained.

With the liquid paper container according to the third aspect of the invention, the side sealing panel has the sealing-portion horizontal folding crease of the side sealing panel, which is to be overlapped with the corresponding one of the sealing-portion horizontal folding creases at the time of sealing. The folding-crease absent portion is provided in the midway of the sealing-portion horizontal folding crease of the side sealing panel. Thus, at the time of sealing, a gap formed between a part of the corresponding sealing-portion horizontal folding crease and the folding-crease absent portion is extremely small. Thus, a far more perfect bonding state is obtained for bonding between the part of the corresponding sealing-portion horizontal folding crease and the folding-crease absent portion than for bonding between a part of the corresponding sealing-portion horizontal folding crease and the sealing-portion horizontal folding crease of the side sealing panel, which overlap with each other.

Thus, during handling such as conveyance, even when a strong pressing force or impact force is applied to the top portion to cause separation in a bonded portion corresponding to the part of the corresponding sealing-portion horizontal folding crease and the sealing-portion horizontal folding crease of the side sealing panel, which are bonded to each other, and a liquid content in the container flows out into the gap between the part of the corresponding sealing-portion horizontal folding crease and the sealing-portion horizontal folding crease of the side sealing panel, which is formed due to the separation occurring in the bonded portion, the bonded portion corresponding to the part of the corresponding sealing-portion horizontal folding crease and the folding-crease absent portion, which overlap with each other, serves as a weir to block the gap. As a result, the leakage of the liquid content to the outside of the container can be prevented. Further, even when the leakage does not occur, the bonded portion corresponding to the part of the corresponding sealing-portion horizontal folding crease and the folding-crease absent portion, which overlap with each other, blocks the gap to prevent the intrusion of, for example, air into the container through the gap between the corresponding sealing-portion horizontal folding crease and the sealing-portion horizontal folding crease of the side sealing panel. As a result, bulge of the body can be prevented.

Further, the folding-crease absent portion is provided in the midway of the sealing-portion horizontal folding crease of the side sealing panel. Thus, at the time of forming the top portion, when the sealing panels are folded along the sealing-portion horizontal folding creases, horizontal folding along the part of the corresponding one of sealing-portion horizontal folding creases and the folding-crease absent portion, which overlap with each other, is guided from both sides in the horizontal folding direction by easily achievable horizontal folding of the part of the sealing-portion horizontal folding crease and the sealing-portion horizontal folding crease of the side sealing panel, which overlap with each other. Thus, the side sealing panel is easily folded. As a result, the sealing panels can easily be folded, and the top portion can easily and reliably be formed.

With the liquid paper container according to the fourth aspect of the invention, the folding-crease absent portion is provided in the midway of the bottom-portion horizontal folding crease of the side sealing panel, which is formed in the side sealing panel. Thus, at the time of sealing, a gap formed between a part of a corresponding one of the bottom-portion horizontal folding creases and the folding-crease absent portion, which overlap with each other, is extremely small. Thus, a far more perfect bonding state is obtained for bonding between the part of the corresponding bottom-portion horizontal folding crease and the folding-crease absent portion than for bonding between a part of the bottom-portion horizontal folding crease and the bottom-portion horizontal folding crease of the side sealing panel, which overlap with each other.

Thus, during handling such as conveyance, even when a strong pressing force or impact force is applied to the bottom portion to cause separation in a bonded portion corresponding to the part of the corresponding bottom-portion horizontal folding crease and the bottom-portion horizontal folding crease of the side sealing panel, which are bonded to each other, and a liquid content in the container flows out into the gap between the part of the corresponding bottom-portion horizontal folding crease and the bottom-portion horizontal folding crease of the side sealing panel, which is formed due to the separation occurring in the bonded portion, the bonded portion corresponding to the part of the corresponding bottom-portion horizontal folding crease and the folding-crease absent portion, which overlap with each other, serves as a weir to block the gap. As a result, the leakage of the liquid content to the outside of the container can be prevented.

Further, the folding-crease absent portion is provided in the midway of the bottom-portion horizontal folding crease of the side sealing panel. Thus, at the time of forming the bottom portion, when the bottom panels and the inner panels are folded inward along the bottom-portion horizontal folding creases, horizontal folding along the part of the corresponding bottom-portion horizontal folding crease and the folding-crease absent portion, which overlap with each other, is guided from both sides in the horizontal folding direction by easily achievable horizontal folding along the corresponding bottom-portion horizontal folding crease and the bottom-portion horizontal folding crease of the side sealing panel, which overlap with each other. As a result, the side sealing panel is easily folded inward. Thus, the bottom panels and the inner panels can easily be folded inward. As a result, the bottom portion can easily and reliably be formed, and sharp corners can be obtained.

With the liquid paper container according to the fifth aspect of the invention, the folding-crease absent portion is provided in the midway of the bottom-portion diagonal folding crease of the side sealing panel, which is formed in the side sealing panel. Thus, at the time of sealing, a gap formed between a part of the corresponding bottom-portion diagonal folding crease and the folding-crease absent portion provided in the midway of the bottom-portion diagonal folding crease of the side sealing panel, which overlap with each other, is extremely small. Thus, a far more perfect bonding state is obtained for bonding between the part of the corresponding bottom-portion diagonal folding crease and the folding-crease absent portion than for bonding between the part of the corresponding bottom-portion diagonal folding crease and the bottom-portion diagonal folding crease of the side sealing panel, which overlap with each other.

Thus, during handling such as conveyance, even when a strong pressing force or impact force is applied to the top portion to cause separation in a bonded portion corresponding to the part of the corresponding bottom-portion diagonal folding crease and the bottom-portion diagonal folding crease of the side sealing panel, which are bonded to each other, and a liquid content in the container flows out into the gap between the part of the corresponding bottom-portion diagonal folding crease and the bottom-portion diagonal folding crease of the side sealing panel, which is formed due to the separation occurring in the bonded portion, the bonded portion corresponding to the part of the corresponding bottom-portion diagonal folding crease and the folding-crease absent portion, which overlap with each other, serves as a weir to block the gap. As a result, the leakage of the liquid content to the outside of the container can be prevented.

Further, the folding-crease absent portion is provided in the midway of the top-portion diagonal folding crease of the side sealing panel. Thus, at the time of forming the bottom portion, when the inner panels are folded inward along the bottom-portion diagonal folding creases, diagonal folding along the part of the corresponding bottom-portion diagonal folding crease and the folding-crease absent portion, which overlap with each other, is guided from both sides in the diagonal folding direction by easily achievable diagonal folding along the corresponding bottom-portion diagonal folding crease and the bottom-portion diagonal folding crease of the side sealing panel, which overlap with each other. As a result, the side sealing panel is easily folded inward. Thus, the bottom-portion diagonal folding crease can easily be folded inward. As a result, the bottom portion can easily and reliably be formed, and sharp corners can be obtained.

With the liquid paper container according to the sixth aspect of the invention, the plurality of the folding-crease absent portions are provided. Thus, even when a length of each of the folding-crease absent portions is short, a blocking effect for the gaps can be attained. Further, even when any one of the plurality of folding-crease absent portions forms a bonded portion in a weakly bonding state, the leakage of the liquid content to the outside of the container and the intrusion of, for example, air into the container can be reliably prevented with the bonded portions formed with the other folding-crease absent portions.

Further, the length of each of the folding-crease absent portions can be set short. Thus, folding at each of the folding-crease absent portions is facilitated.

With the liquid paper container according to the seventh aspect of the invention, each of the folding-crease absent portions falls within the range of from 13% to 40% of the width of the side sealing panel. Thus, the leakage of the liquid content to the outside of the container and the intrusion of, for example, air into the container can be reliably prevented by the bonded portions formed with the folding-crease absent portions.

DESCRIPTION OF EMBODIMENTS

Now, a liquid paper container according to each embodiment of the present invention is described in detail with reference to the drawings.

Figure 1:
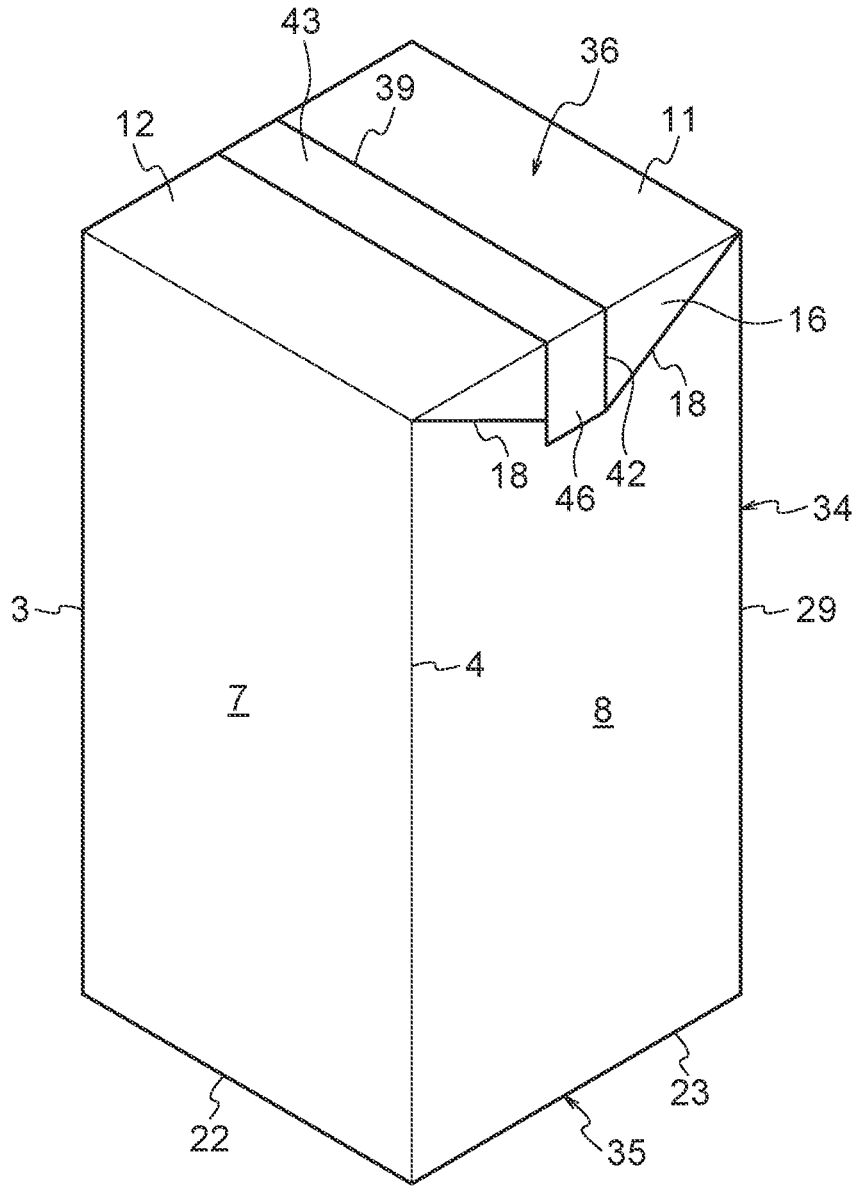
FIG. 1 is a perspective view for illustrating a first example of an embodiment of a liquid paper container according to the present invention.
Figure 2:
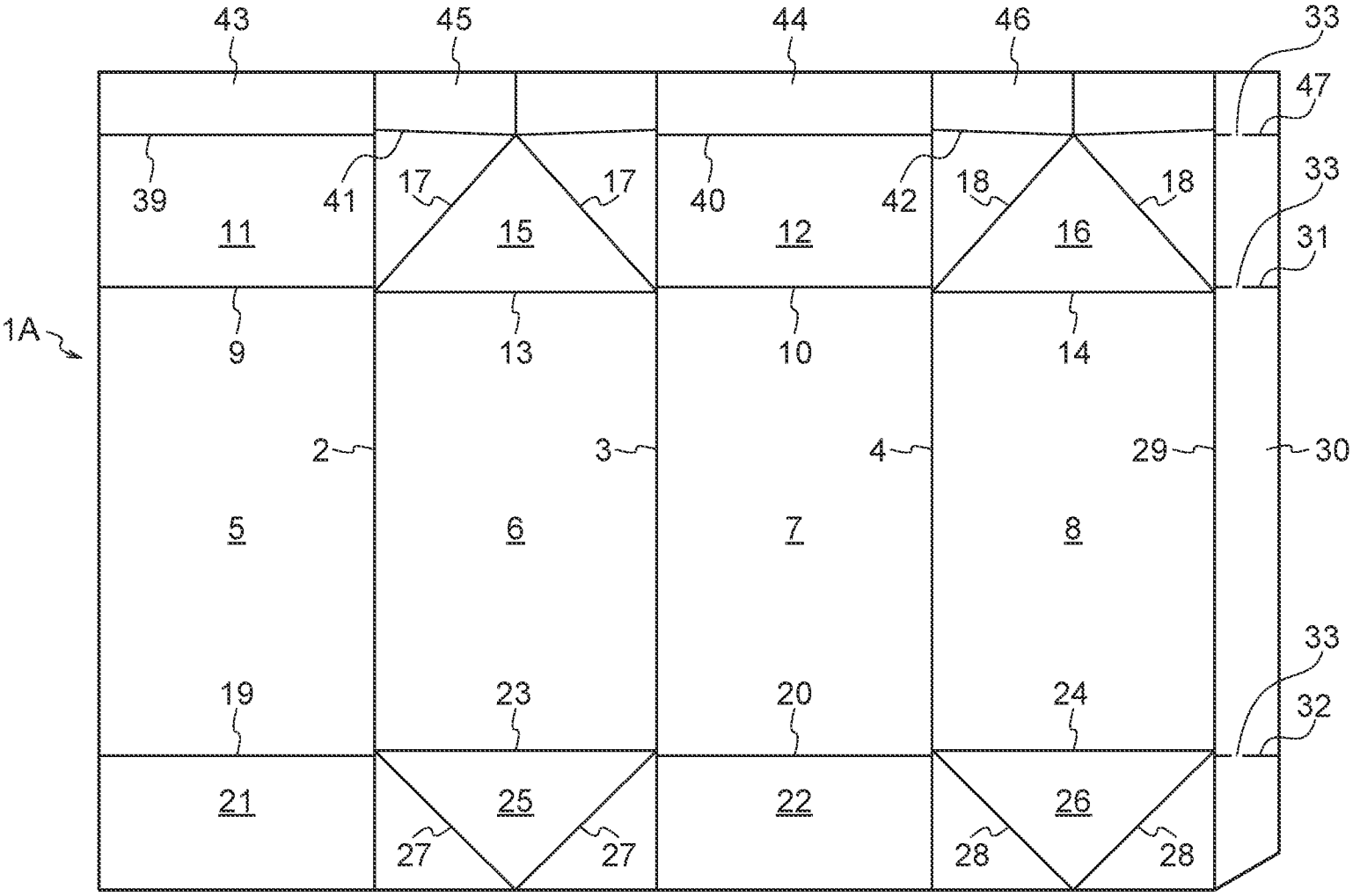
FIG. 2 is a plan view for illustrating a blank sheet for forming the liquid paper container of the first example.
Figure 3:
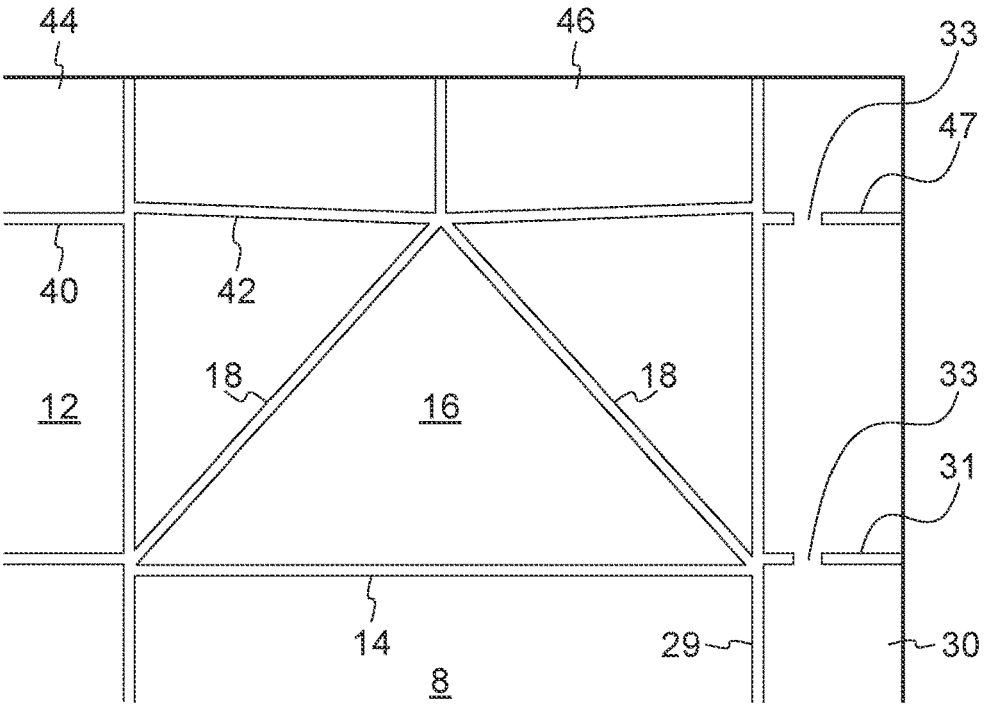
FIG. 3 is an enlarged view of a main part of FIG. 2.
Figure 4:
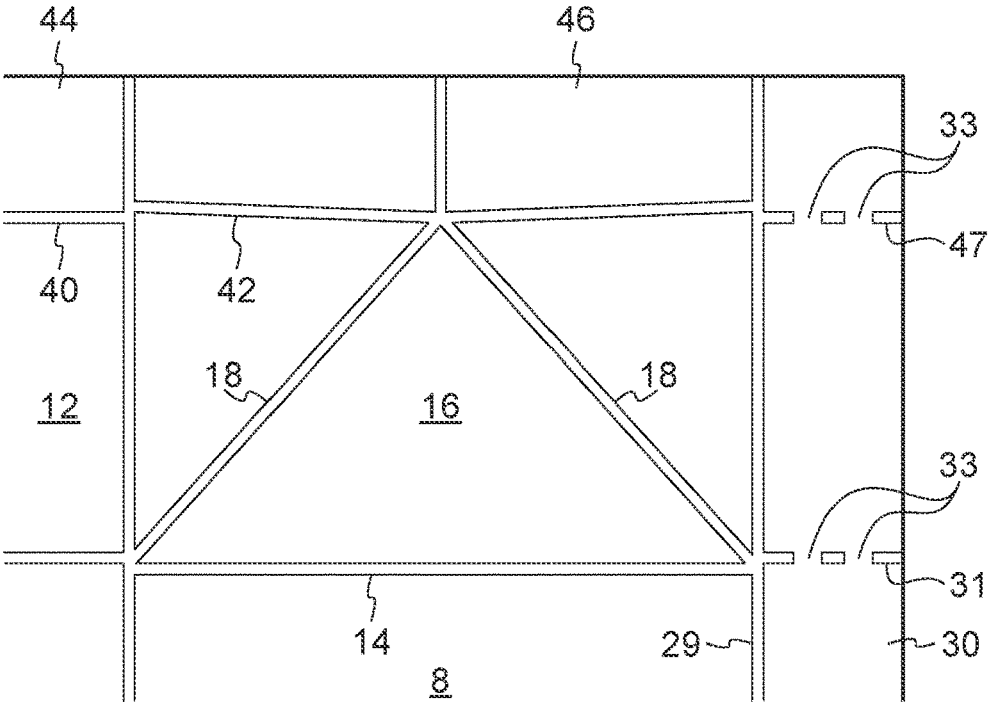
FIG. 4 is a plan view for illustrating another example of folding-crease absent portions provided in the midway of a top-portion horizontal folding crease of a side sealing panel in the first example.

FIG. 1 to FIG. 4 are illustrations of a first example of an embodiment of a liquid paper container according to the present invention. FIG. 1 is a perspective view for illustrating the liquid paper container of the first example. FIG. 2 is a plan view for illustrating a blank sheet for forming the liquid paper container of the first example. FIG. 3 is an enlarged view of a main part of FIG. 2. FIG. 4 is a plan view for illustrating another example of folding-crease absent portions provided in the midway of a top-portion horizontal folding crease of a side sealing panel in the first example.

The liquid paper container of the first example is a liquid paper container having a flat top-type top portion, and is formed from a blank sheet 1A illustrated in FIG. 2.

The blank sheet 1A for forming the liquid paper container of the first example is made of a paper material having a thermoplastic resin laminated on each of a front surface and a back surface. The blank sheet 1A includes four body panels 5, 6, 7, and 8, which are contiguous with each other through body vertical folding lines 2, 3, and 4.

A top panel 11 is contiguous with an upper end of the body panel 5 through a top-portion horizontal folding crease 9, and a top panel 12 is contiguous with an upper end of the body panel 7 through a top-portion horizontal folding crease 10. A pair of the top panels 11 and 12 are opposed to each other. A side panel 15 is contiguous with an upper end of the body panel 6 through a top-portion horizontal folding crease 13, and a side panel 16 is contiguous with an upper end of the body panel 8 through a top-portion horizontal folding crease 14. A pair of the side panels 15 and 16 are each positioned between the top panels 11 and 12, and are opposed to each other. Top-portion diagonal folding creases 17 are formed in the side panel 15, and top-portion diagonal folding creases 18 are formed in the side panel 16. Further, a sealing panel 43 is contiguous with an upper end of the top panel 11 through a sealing-portion horizontal folding crease 39. A sealing panel 44 is contiguous with an upper end of the top panel 12 through a sealing-portion horizontal folding crease 40. A sealing panel 45 is contiguous with an upper end of the side panel 15 through a sealing-portion horizontal folding crease 41. A sealing panel 46 is contiguous with an upper end of the side panel 16 through a sealing-portion horizontal folding crease 42.

A bottom panel 21 is contiguous with a lower end of the body panel 5 through a bottom-portion horizontal folding crease 19, and a bottom panel 22 is contiguous with a lower end of the body panel 7 through a bottom-portion horizontal folding crease 20. A pair of the bottom panels 21 and 22 are opposed to each other. An inner panel 25 is contiguous with a lower end of the body panel 6 through a bottom-portion horizontal folding crease 23, and an inner panel 26 is contiguous with a lower end of the body panel 8 through a bottom-portion horizontal folding crease 24. A pair of the inner panels 25 and 26 are each positioned between the bottom panels 21 and 22, and are opposed to each other. Bottom-portion diagonal folding creases 27 are formed in the inner panel 25, and bottom-portion diagonal folding creases 28 are formed in the inner panel 26.

A side sealing panel 30 is contiguous with a one-side open end edge of the blank sheet 1A having the structure described above, in the first example, with open end edges of the body panel 8, the side panel 16, and the inner panel 26. The side sealing panel 30 is to be sealed to an another-side open end edge of the brank sheet 1A through a vertical folding crease 29 at a boundary of the side sealing panel 30. The side sealing panel 30 has a top-portion horizontal folding crease 31 of the side sealing panel 30, a bottom-portion horizontal folding crease 32 of the side sealing panel 30, and a sealing-portion horizontal folding crease 47 of the side sealing panel 30. At the time of sealing, the top-portion horizontal folding crease 31 of the side sealing panel 30 is overlapped with the top-portion horizontal folding crease 9 on the another-side open end edge side of the blank sheet 1A, the bottom-portion horizontal folding crease 32 of the side sealing panel 30 is overlapped with the bottom-portion horizontal folding crease 19 on the another-side open end edge side, and the sealing-portion horizontal folding crease 47 of the side sealing panel 30 is overlapped with the sealing-portion horizontal folding crease 39 on the another-side open end edge side. In this example, a folding-crease absent portion 33 is provided in the midway of each of the top-portion horizontal folding crease 31 of the side sealing panel 30, the bottom-portion horizontal folding crease 32 of the side sealing panel 30, and the sealing-portion horizontal folding crease 47 of the side sealing panel 30.

The number of folding-crease absent portions 33 provided in the midway of each of the top-portion horizontal folding crease 31 of the side sealing panel 30, the bottom-portion horizontal folding crease 32 of the side sealing panel 30, and the sealing-portion horizontal folding crease 47 of the side sealing panel 30 is one in the first example. However, a plurality of folding-crease absent portions 33 may be provided as illustrated in FIG. 4.

Further, it is preferred that a ratio of the folding-crease absent portion 33 provided in each of the top-portion horizontal folding crease 31 of the side sealing panel 30, the bottom-portion horizontal folding crease 32 of the side sealing panel 30, and the sealing-portion horizontal folding crease 47 of the side sealing panel 30 fall within a range of from 13% to 40% of a width of the side sealing panel 30.

When the ratio of the folding-crease absent portion 33 provided in each of the top-portion horizontal folding crease 31 of the side sealing panel 30, the bottom-portion horizontal folding crease 32 of the side sealing panel 30, and the sealing-portion horizontal folding crease 47 of the side sealing panel 30 is smaller than 13% of the width of the side sealing panel 30, there may arise the following possibility. Specifically, when a strong pressing force or impact force is applied to the top portion or a bottom portion as described later, separation may occur in a bonded portion corresponding to a part of the top-portion horizontal folding crease 9 and the folding-crease absent portion 33, which overlap with each other, a bonded portion corresponding to a part of the sealing-portion horizontal folding crease 39 and the folding-crease absent portion 33, which overlap with each other, and a bonded portion corresponding to a part of the bottom-portion horizontal folding crease 19 and the folding-crease absent portion 33, which overlap with each other. As a result, a gap, which has been blocked by each of the bonded portions, may be formed between the top-portion horizontal folding crease 9 and the top-portion horizontal folding crease 31 of the side sealing panel 30, between the sealing-portion horizontal folding crease 39 and the sealing-portion horizontal folding crease 47 of the side sealing panel 30, or between the bottom-portion horizontal folding crease 19 and the bottom-portion horizontal folding crease 32 of the side sealing panel 30.

Further, in a case in which the ratio of the folding-crease absent portion 33 exceeds 40%, when the top panels 11 and 12 and the side panels 15 and 16 are folded inward, the sealing panels 43, 44, 45, and 46 are folded along the sealing-portion horizontal folding creases 39, 40, 41, and 42, or the bottom panels 21 and 22 and the inner panels 25 and 26 are folded inward, it is difficult to smoothly fold inward the bonded portions, each including a corresponding one of the folding-crease absent portions 33 in an overlapping manner. Thus, there is a fear in that sharp corners cannot be formed by folding.

For the formation of the liquid paper container of the first example with the blank sheet 1A, the blank sheet 1A is first mountain-folded along the body vertical folding lines 2, 3, and 4, and the vertical folding crease 29 at the boundary of the side sealing panel 30. Then, the side sealing panel 30 is sealed to the open end edges of the body panel 5, the top panel 11, and the bottom panel 21 on the another-side open end edge side of the blank sheet 1 to thereby form a body 34 having a rectangular shape.

At the time of sealing of the side sealing panel 30, the side sealing panel 30 is sealed under a state in which the top-portion horizontal folding crease 31 of the side sealing panel 30, which is formed in the side sealing panel 30, and a part of the top-portion horizontal folding crease 9 overlap with each other. The folding-crease absent portion 33 is provided in the midway of the top-portion horizontal folding crease 31 of the side sealing panel 30. Thus, a gap formed between the part of the top-portion horizontal folding crease 9 and the folding-crease absent portion 33, which overlap with each other, is extremely small. Thus, a bonding state of the bonding between the part of the top-portion horizontal folding crease 9 and the folding-crease absent portion 33 is far more perfect than a bonding state of the bonding between the part of the top-portion horizontal folding crease 9 and the top-portion horizontal folding crease 31 of the side sealing panel 30, which overlap with each other.

Further, similarly, the side sealing panel 30 is sealed under a state in which the sealing-portion horizontal folding crease 47 of the side sealing panel 30, which is formed in the side sealing panel 30, and a part of the sealing-portion horizontal folding crease 39 overlap with each other. The folding-crease absent portion 33 is provided in the midway of the sealing-portion horizontal folding crease 47 of the side sealing panel 30. Thus, a gap formed between the part of the sealing-portion horizontal folding crease 39 and the folding-crease absent portion 33, which overlap with each other, is extremely small. Thus, a bonding state of the bonding between the part of the sealing-portion horizontal folding crease 39 and the folding-crease absent portion 33 is far more perfect than a bonding state of the bonding between the part of the sealing-portion horizontal folding crease 39 and the sealing-portion horizontal folding crease 47 of the side sealing panel 30, which overlap with each other.

Further, similarly, the side sealing panel 30 is sealed under a state in which the bottom-portion horizontal folding crease 32 of the side sealing panel 30, which is formed in the side sealing panel 30, and a part of the bottom-portion horizontal folding crease 19 overlap with each other. The folding-crease absent portion 33 is provided in the midway of the bottom-portion horizontal folding crease 32 of the side sealing panel 30. Thus, a gap formed between the part of the bottom-portion horizontal folding crease 19 and the folding-crease absent portion 33, which overlap with each other, is extremely small. Thus, a bonding state of the bonding between the part of the bottom-portion horizontal folding crease 19 and the folding-crease absent portion 33 is far more perfect than a bonding state of the bonding between the part of the bottom-portion horizontal folding crease 19 and the bottom-portion horizontal folding crease 32 of the side sealing panel 30, which overlap with each other.

Next, the bottom panels 21 and 22, which are respectively contiguous with the lower end of the body panel 5 and the lower end of the body panel 7, and the inner panels 25 and 26, which are respectively contiguous with the lower end of the body panel 6 and the lower end of the body panel 8, are folded inward and sealed so as to be tightly closed to thereby form a bottom portion 35. At the time of forming the bottom portion 35, the side sealing panel 30 is folded inward along the bottom-portion horizontal folding crease 32 of the side sealing panel 30 together with the bottom panel 21.

The folding-crease absent portion 33 is provided in the midway of the bottom-portion horizontal folding crease 32 of the side sealing panel 30. Bonding at the folding-crease absent portion 33 becomes strong bonding. Thus, at the time of folding, bending along the part of the bottom-portion horizontal folding crease 19, which overlaps with the folding-crease absent portion 33, becomes more difficult than that along the part of the bottom-portion horizontal folding crease 19 and the bottom-portion horizontal folding crease 32 of the side sealing panel 30, which overlap with each other. However, horizontal folding along the part of the bottom-portion horizontal folding crease 19, which overlaps with the folding-crease absent portion 33, is guided from both sides in the horizontal folding direction by easily achievable horizontal folding along the part of the bottom-portion horizontal folding crease 19 and the bottom-portion horizontal folding crease 32 of the side sealing panel 30, which overlap with each other. As a result, the side sealing panel 30 can easily be folded inward.

Then, after a liquid beverage is filled in, the top panels 11 and 12, which are respectively contiguous with the upper end of the body panel 5 and the upper end of the body panel 7, and the side panels 15 and 16, which are respectively contiguous with the upper end of the body panel 6 and the upper end of the body panel 8, are folded inward. Then, the sealing panels 43, 44, 45, and 46 are overlapped with each other and sealed so as to be tightly closed to thereby form a top portion 36. At the time of forming the top portion 36, the side sealing panel 30 is also folded inward along the top-portion horizontal folding crease 31 of the side sealing panel 30 together with the top panel 11.

The folding-crease absent portion 33 is provided in the midway of the top-portion horizontal folding crease 31 of the side sealing panel 30. Bonding at the folding-crease absent portion 33 becomes strong bonding. Thus, at the time of folding, bending along the part of the top-portion horizontal folding crease 9, which overlaps with the folding-crease absent portion 33, becomes more difficult than that along the part of the top-portion horizontal folding crease 9 and the top-portion horizontal folding crease 31 of the side sealing panel 30, which overlap with each other. However, horizontal folding along the part of the top-portion horizontal folding crease 9, which overlaps with the folding-crease absent portion 33, is guided from both sides in the horizontal folding direction by easily achievable horizontal folding along the part of the top-portion horizontal folding crease 9 and the top-portion horizontal folding crease 31 of the side sealing panel 30, which overlap with each other. As a result, the side sealing panel 30 can easily be folded inward.

Further, at the time of sealing of the sealing panels 43, 44, 45, and 46, the side sealing panel 30 is folded along the sealing-portion horizontal folding crease 47 of the side sealing panel 30 together with the sealing panel 43.

The folding-crease absent portion 33 is provided in the midway of the sealing-portion horizontal folding crease 47 of the side sealing panel 30. Bonding at the folding-crease absent portion 33 becomes strong bonding. Thus, at the time of folding, bending along the part of the sealing-portion horizontal folding crease 39, which overlaps with the folding-crease absent portion 33, becomes more difficult than that along the part of the sealing-portion horizontal folding crease 39 and the sealing-portion horizontal folding crease 47 of the side sealing panel 30, which overlap with each other. However, horizontal folding along the part of the sealing-portion horizontal folding crease 39, which overlaps with the folding-crease absent portion 33, is guided from both sides in the horizontal folding direction by easily achievable horizontal folding along the part of the sealing-portion horizontal folding crease 39 and the sealing-portion horizontal folding crease 47 of the side sealing panel 30, which overlap with each other. As a result, the side sealing panel 30 can easily be folded inward.

With the liquid paper container of the first example, which has the structure described above, the folding-crease absent portion 33 is provided in the midway of the top-portion horizontal folding crease 31 of the side sealing panel 30, which is formed in the side sealing panel 30. Thus, at the time of sealing, the gap formed between the part of the top-portion horizontal folding crease 9 and the folding-crease absent portion 33, which overlap with each other, is extremely small. Thus, a far more perfect bonding state is obtained for the bonding between the part of the top-portion horizontal folding crease 9 and the folding-crease absent portion 33 than for the bonding between the part of the top-portion horizontal folding crease 9 and the top-portion horizontal folding crease 31 of the side sealing panel 30, which overlap with each other.

Further, the folding-crease absent portion 33 is provided in the midway of the sealing-portion horizontal folding crease 47 of the side sealing panel 30, which is formed in the side sealing panel 30. Thus, at the time of sealing, the gap formed between the part of the sealing-portion horizontal folding crease 39 and the folding-crease absent portion 33, which overlap with each other, is extremely small. Thus, a far more perfect bonding state is obtained for the bonding between the part of the sealing-portion horizontal folding crease 39 and the folding-crease absent portion 33 than for the bonding between the part of the sealing-portion horizontal folding crease 39 and the sealing-portion horizontal folding crease 47 of the side sealing panel 30, which overlap with each other.

Further, the folding-crease absent portion 33 is provided in the midway of the bottom-portion horizontal folding crease 32 of the side sealing panel 30, which is formed in the side sealing panel 30. Thus, at the time of sealing, the gap formed between the part of the bottom-portion horizontal folding crease 19 and the folding-crease absent portion 33, which overlap with each other, is extremely small. Thus, a far more perfect bonding state is obtained for the bonding between the part of the bottom-portion horizontal folding crease 19 and the folding-crease absent portion 33 than for the bonding between the part of the bottom-portion horizontal folding crease 19 and the bottom-portion horizontal folding crease 32 of the side sealing panel 30, which overlap with each other.

Further, the folding-crease absent portion 33 is provided in the midway of each of the top-portion horizontal folding crease 31 of the side sealing panel 30, the bottom-portion horizontal folding crease 32 of the side sealing panel 30, and the sealing-portion horizontal folding crease 47 of the side sealing panel 30. Thus, at the time of forming the top portion 36 and the bottom portion 35, bending at the bonded portions respectively formed with the folding-crease absent portion 33 provided in the midway of each of the top-portion horizontal folding crease 31 of the side sealing panel 30, the bottom-portion horizontal folding crease 32 of the side sealing panel 30, and the sealing-portion horizontal folding-crease 47 of the side sealing panel 30 becomes difficult. However, horizontal folding along the part of the top-portion horizontal folding crease 31 of the side sealing panel 30, the part of the bottom-portion horizontal folding crease 32 of the side sealing panel 30, and the part of the sealing-portion horizontal folding crease 47 of the side sealing panel 30, which respectively overlap with the folding-crease absent portions 33, is guided from both sides in the horizontal folding direction by easily achievable horizontal folding along the part of the top-portion horizontal folding crease 9 and the top-portion horizontal folding crease 31 of the side sealing panel 30, which overlap with each other, along the part of the sealing-portion horizontal folding crease 39 and the sealing-portion horizontal folding crease 47 of the side sealing panel 30, which overlap with each other, and along the part of the bottom-portion horizontal folding crease 19 and the bottom top-portion horizontal folding crease 32 of the side sealing panel 30, which overlap with each other. As a result, the side sealing panel 30 can easily be folded inward. Thus, the inward folding of the top panels 11 and 12 and the side panels 15 and 16, the inward folding of the bottom panels 21 and 22 and the inner panels 25 and 26, and the folding of the sealing panels 43, 44, 45, and 46 are facilitated.

Further, in the first example, the number of folding-crease absent portions 33 provided in the midway of each of the top-portion horizontal folding crease 31 of the side sealing panel 30, the bottom-portion horizontal folding crease 32 of the side sealing panel 30, and the sealing-portion horizontal folding crease 47 of the side sealing panel 30 is one in the first example. However, a plurality of folding-crease absent portions 33 may be provided as illustrated in FIG. 4. In the case in which the plurality of the folding-crease absent portions are provided even when a length of each of the folding-crease absent portions 33 is short, a blocking effect for the gaps can be attained. Further, even when any one of the plurality of folding-crease absent portions 33 forms a bonded portion in a weakly bonding state, the leakage of the liquid content to the outside of the container and the intrusion of, for example, air into the container can be reliably prevented with the bonded portions formed with the other folding-crease absent portions.

Further, a length of each of the folding-crease absent portions 33 can be set short. Thus, folding at each of the folding-crease absent portions 33 becomes easy. Thus, at the time of forming the top portion 36 and the bottom portion 35, the inward folding of the top panels 11 and 12 and the side panels 15 and 16, the inward folding of the bottom panels 21 and 22 and the inner panels 25 and 26, and the folding of the sealing panels 43, 44, 45, and 46 are facilitated.

Further, it is preferred that a ratio of the folding-crease absent portion 33 provided in each of the top-portion horizontal folding crease 31 of the side sealing panel 30, the bottom-portion horizontal folding crease 32 of the side sealing panel 30, and the sealing-portion horizontal folding crease 47 of the side sealing panel 30 fall within a range of from 13% to 40% of a width of the side sealing panel 30. When the folding-crease absent portion 33 provided in each of the top-portion horizontal folding crease 31 of the side sealing panel 30, the bottom-portion horizontal folding crease 32 of the side sealing panel 30, and the sealing-portion horizontal folding crease 47 of the side sealing panel 30 is set to fall within the range of from 13% to 40% of the width of the side sealing panel 30, the bonded portions corresponding to the part of the top-portion horizontal folding crease 9, the part of the bottom-portion horizontal folding crease 19, and the part of the sealing-portion horizontal folding crease 39, which respectively overlap with the folding-crease absent portions 33, block the gaps. As a result, the leakage of a liquid content to the outside of the container and the intrusion of, for example, air into the container can be more reliably prevented. Further, the side sealing panel 30 becomes easily foldable at the folding-crease absent portions 33. Thus, at the time of forming the top portion 36 and the bottom portion 35, the inward folding of the top panels 11 and 12 and the side panels 15 and 16, the inward folding of the bottom panels 21 and 22 and the inner panels 25 and 26, and the folding of the sealing panels 43, 44, 45, and 46 are further facilitated.

In the first example, the present invention is carried out for the liquid paper container having the flat top-type top portion. However, the present invention can also be carried out for a gable top-type liquid paper container having a gable top-type top portion.

Figure 5:
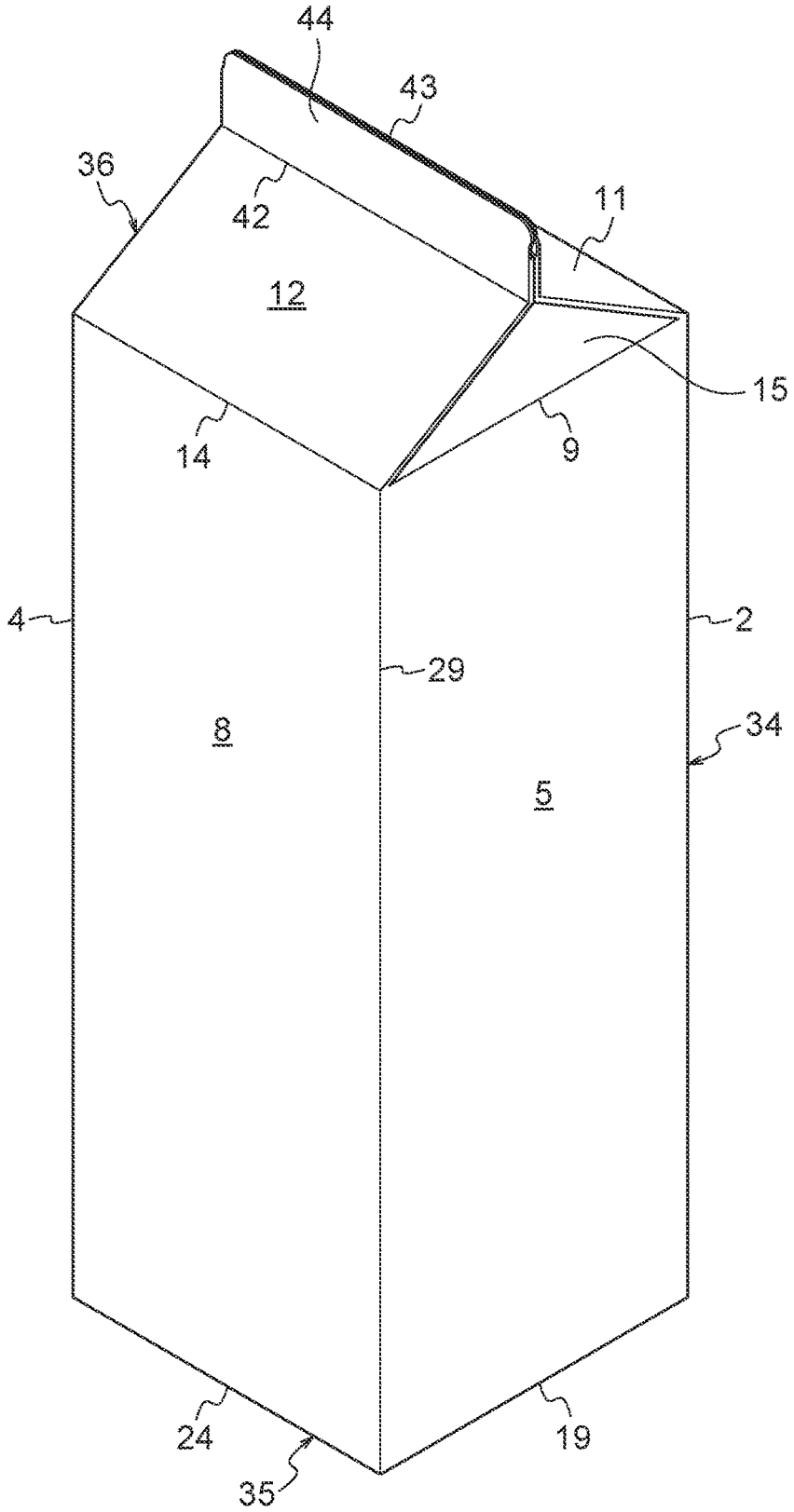
FIG. 5 is a perspective view for illustrating a second example of an embodiment of a liquid paper container according to the present invention.
Figure 6:
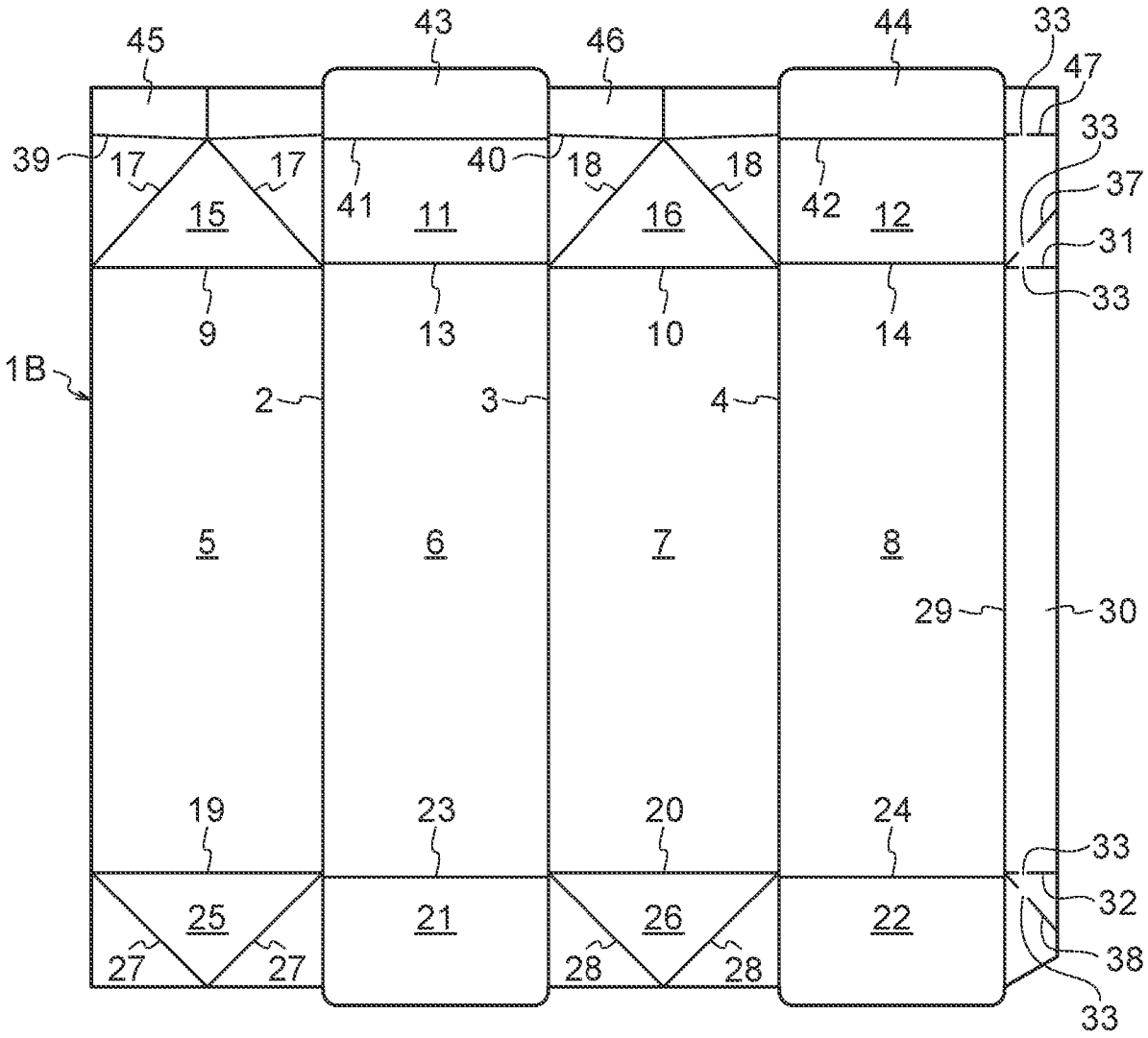
FIG. 6 is a plan view for illustrating a blank sheet for forming the liquid paper container of the second example.
Figure 7:
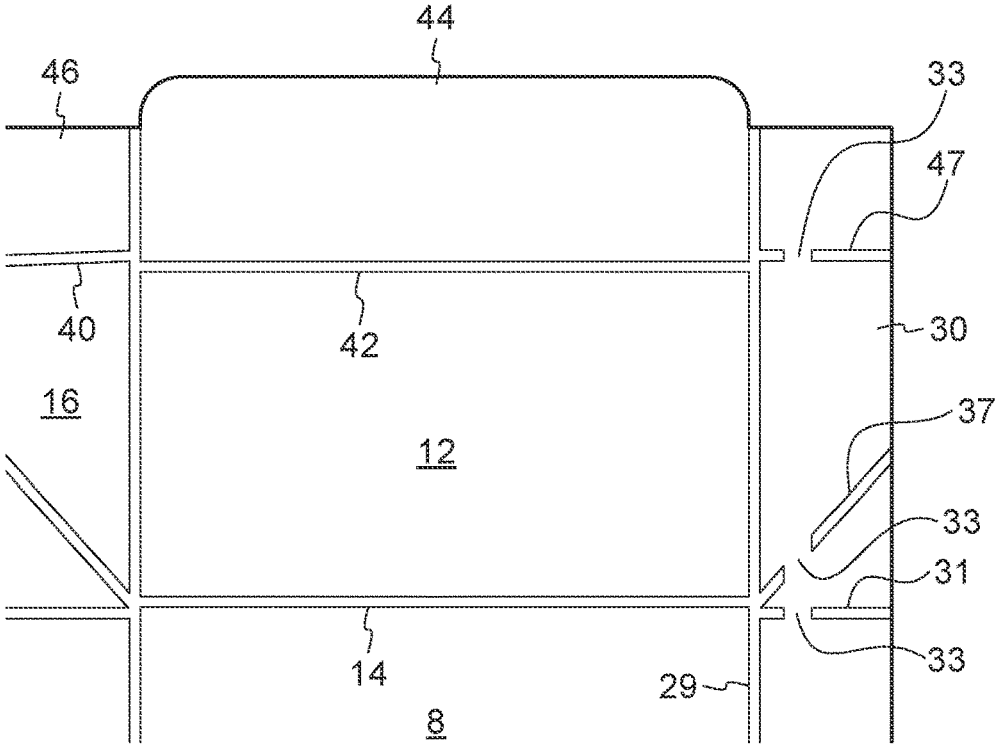
FIG. 7 is an enlarged view of a main part of FIG. 5.
Figure 8:
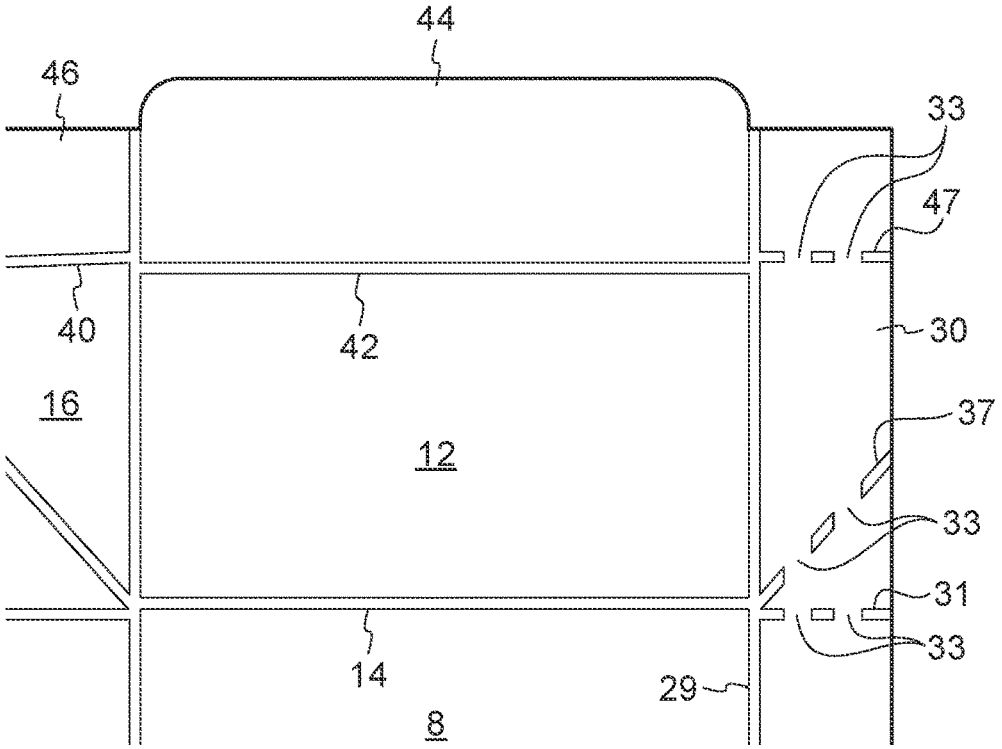
FIG. 8 is a plan view for illustrating another example of folding-crease absent portions provided in the midway of the top-portion horizontal folding crease of the side sealing panel in the second example.

FIG. 5 to FIG. 8 are illustrations of a second example of an embodiment of a liquid paper container according to the present invention. FIG. 5 is a perspective view of the liquid paper container of the second example. FIG. 6 is a plan view for illustrating a blank sheet for forming the liquid paper container of the second example. FIG. 7 is an enlarged view of a main part of FIG. 6. FIG. 8 is a plan view for illustrating another example of folding-crease absent portions provided in the midway of a top-portion horizontal folding crease of a side sealing panel in the second example.

For the liquid paper container of the second example, the same structures as those of the first example are denoted by the same reference symbols, and the description thereof is herein omitted. Only structures different from those of the first example are described.

The liquid paper container of the second example is a gable top-type liquid paper container having a gable top-type top portion as a top portion, and is formed from a blank sheet 1B illustrated in FIG. 6.

The blank sheet 1 for forming the liquid paper container of the second example is made of a paper material having a thermoplastic resin laminated on each of a front surface and a back surface. The blank sheet 1 has four body panels 5, 6, 7, and 8, which are contiguous with each other through the body vertical folding lines 2, 3, and 4.

The top panel 11 is contiguous with the upper end of the body panel 6 through the top-portion horizontal folding crease 13, and the top panel 12 is contiguous with the upper end of the body panel 8 through the top-portion horizontal folding crease 14. The pair of top panels 11 and 12 are opposed to each other. The side panel 15 is contiguous with the upper end of the body panel 5 through the top-portion horizontal folding crease 9, and the side panel 16 is contiguous with the upper end of the body panel 7 through the top-portion horizontal folding crease 10. The top panels 11 and 12 form gable top walls, and the side panels 15 and 16 form a pair of gable walls. The side panels 15 and 16 are each positioned between the top panels 11 and 12, and are opposed to each other. The top-portion diagonal folding creases 17 are formed in the side panel 15, and the top-portion diagonal folding creases 18 are formed in the side panel 16. Further, the sealing panel 43 is contiguous with the upper end of the top panel 11 through the sealing-portion horizontal folding crease 39. The sealing panel 44 is contiguous with the upper end of the top panel 12 through the sealing-portion horizontal folding crease 40. The sealing panel 45 is contiguous with the upper end of the side panel 15 through the sealing-portion horizontal folding crease 41. The sealing panel 46 is contiguous with the upper end of the side panel 16 through the sealing-portion horizontal folding crease 42.

The bottom panel 21 is contiguous with the lower end of the body panel 6 through the bottom-portion horizontal folding crease 23, and the bottom panel 22 is contiguous with the lower end of the body panel 8 through the bottom-portion horizontal folding crease 24. A pair of the bottom panels 21 and 22 are opposed to each other. The inner panel 25 is contiguous with the lower end of the body panel 5 through the bottom-portion horizontal folding crease 19, and the inner panel 26 is contiguous with the lower end of the body panel 7 through the bottom-portion horizontal folding crease 20. A pair of the inner panels 25 and 26 are each positioned between the bottom panels 21 and 22, and are opposed to each other. The bottom-portion diagonal folding creases 27 are formed in the inner panel 25, and the bottom-portion diagonal folding creases 28 are formed in the inner panel 26.

The side sealing panel 30 is contiguous with a one-side open end edge of the blank sheet 1B having the structure described above, in the second example, with open end edges of the body panel 8, the top panel 12, and the bottom panel 22. The side sealing panel 30 is to be sealed to an another-side open end edge of the brank sheet 1B through the vertical folding crease 29 at a boundary of the side sealing panel 30.

The side sealing panel 30 has the top-portion horizontal folding crease 31 of the side sealing panel 30, the bottom-portion horizontal folding crease 32 of the side sealing panel 30, and the sealing-portion horizontal folding crease 47 of the side sealing panel 30. At the time of sealing, as in the first example, the top-portion horizontal folding crease 31 of the side sealing panel 30 is overlapped with a part of the top-portion horizontal folding crease 9 on the another-side open end edge side of the blank sheet 1B, the bottom-portion horizontal folding crease 32 of the side sealing panel 30 is overlapped with a part of the bottom-portion horizontal folding crease 19, and the sealing-portion horizontal folding crease 47 of the side sealing panel 30 is overlapped with a part of the sealing-portion horizontal folding crease 39. Further, the side sealing panel 30 has a top-portion diagonal folding crease 37 of the side sealing panel 30 and a bottom-portion diagonal folding crease 38 of the side sealing panel 30. At the time of sealing, the top-portion diagonal folding crease 37 of the side sealing panel 30 is overlapped with apart of a corresponding one of the top-portion diagonal folding creases 17 of the side panel 15, and the bottom-portion diagonal folding crease 38 of the side sealing panel is overlapped with a part of a corresponding one of the bottom-portion diagonal folding creases 27 of the inner panel 25.

In the second example, the folding-crease absent portion 33 is provided in the midway of each of the top-portion horizontal folding crease 31 of the side sealing panel 30, the bottom-portion horizontal folding crease 32 of the side sealing panel 30, the sealing-portion horizontal folding crease 47 of the side sealing panel 30, the top-portion diagonal folding crease 37 of the side sealing panel 30, and the bottom-portion diagonal folding crease 38 of the side sealing panel 30.

In the second example, the folding-crease absent portions 33 respectively provided in the top-portion horizontal folding crease 31 of the side sealing panel 30, the sealing-portion horizontal folding crease 47 of the side sealing panel 30, and the top-portion diagonal folding crease 37 of the side sealing panel 30, which are formed in the side sealing panel 30, are provided so that positions thereof are aligned with each other and widths thereof match with each other in a vertical direction of the side sealing panel 30. Further, the folding-crease absent portions 33 respectively provided in the bottom-portion horizontal folding crease 32 of the side sealing panel 30 and in the bottom-portion diagonal folding crease 38 of the side sealing panel 30 are formed so that positions thereof are aligned with each other and widths thereof match with each other in the vertical direction of the side sealing panel 30 (see FIG. 7).

The number of folding-crease absent portions 33 provided in the midway of each of the top-portion horizontal folding crease 31 of the side sealing panel 30, the sealing-portion horizontal folding crease 47 of the side sealing panel 30, the bottom-portion horizontal folding crease 32 of the side sealing panel 30, the top-portion diagonal folding crease 37 of the side sealing panel 30, and the bottom-portion diagonal folding crease 38 of the side sealing panel 30 is one in the second example. However, a plurality of the folding-crease absent portions 33 may be provided as illustrated in FIG. 8.

Further, it is preferred that a ratio of the folding-crease absent portion 33 provided in the midway of each of the top-portion horizontal folding crease 31 of the side sealing panel 30, the sealing-portion horizontal folding crease 47 of the side sealing panel 30, the bottom-portion horizontal folding crease 32 of the side sealing panel 30, the top-portion diagonal folding crease 37 of the side sealing panel 30, and the bottom-portion diagonal folding crease 38 of the side sealing panel 30 fall within a range of from 13% to 40% of the width of the side sealing panel 30.

The liquid paper container of the second example is formed from the blank sheet 1B described above in the same manner as in the first example, and thus the description of the first example is used as the description of the liquid paper container of the second example.

With the liquid paper container of the second example, which has the structure described above, the folding-crease absent portion 33 is provided in each of the top-portion diagonal folding crease 37 of the side sealing panel 30 and the bottom-portion diagonal folding crease 38 of the side sealing panel 30, which are formed in the side sealing panel 30. Thus, at the time of sealing, a gap formed between a part of a corresponding one of the top-portion diagonal folding creases 17 and the folding-crease absent portion 33 provided in the midway of the top-portion diagonal folding crease 37 of the side sealing panel 30, which overlap with each other, is extremely small, and a gap formed between apart of a corresponding one of the bottom-portion diagonal folding creases 27 and the folding-crease absent portion 33 provided in the midway of the bottom-top portion diagonal folding crease 38 of the side sealing panel 30, which overlap with each other, is extremely small. Thus, a far more perfect bonding state is obtained for bonding between the above-mentioned portions than for bonding between a part of the corresponding one of the top-portion diagonal folding creases 17 and the top-portion diagonal folding crease 37 of the side sealing panel 30, which overlap with each other, and for bonding between a part of the corresponding one of the bottom-portion diagonal folding creases 27 and the bottom-portion diagonal folding crease 38 of the side sealing panel 30, which overlap with each other.

Further, the folding-crease absent portion 33 is provided in the midway of each of the top-portion diagonal folding crease 37 of the side sealing panel 30 and the bottom-top portion diagonal folding crease 38 of the side sealing panel 30. Thus, at the time of forming the top portion 36 and the bottom portion 35, bending at bonded portions formed with the folding-crease absent portions 33 respectively provided in the midway of the top-portion diagonal folding crease 37 of the side sealing panel 30 and in the midway of the bottom-top portion diagonal folding crease 38 of the side sealing panel 30 becomes difficult. However, horizontal folding at the bonded portions is guided from both sides in a diagonal folding direction by easily achievable diagonal folding along the part of the corresponding one of the top-portion diagonal folding creases 17 and the top-portion diagonal folding crease 37 of the side sealing panel 30, which overlap with each other, and easily achievable diagonal folding along the part of the corresponding one of the bottom-portion diagonal folding creases 27 and the bottom-top portion diagonal folding crease 38 of the side sealing panel 30, which overlap with each other. As a result, the side sealing panel 30 is easily folded inward. Thus, the inward folding of the top panels 11 and 12 and the side panels 15 and 16 and the inward folding of the bottom panels 21 and 22 and the inner panels 25 and 26 are facilitated.

Further, in the second example, the folding-crease absent portions 33 are respectively provided in the top-portion horizontal folding crease 31 of the side sealing panel 30, the sealing-portion horizontal folding crease 47 of the side sealing panel 30, and the top-portion diagonal folding crease 37 of the side sealing panel 30 are formed in the side sealing panel 30 so that the positions thereof are aligned with each other and the widths thereof match with each other in the vertical direction of the side sealing panel 30, and the folding-crease absent portions 33 respectively provided in the bottom-portion horizontal folding crease 32 of the side sealing panel 30 and the bottom-portion diagonal folding crease 38 of the side sealing panel 30 are provided so that the positions thereof are aligned with each other and the widths thereof match with each other in the vertical direction of the side sealing panel 30. Thus, at the time of forming the top portion 36 and the bottom portion 35, when the side panel 15 is horizontally folded along the top-portion horizontal folding crease 9 and is diagonally folded inward along the top-portion diagonal folding creases 17, and the sealing panel 45 is folded, flexing resistances at the bonded portions, which are applied to the top-portion horizontal folding crease 31 of the side sealing panel 30, the sealing-portion horizontal folding crease 47 of the side sealing panel 30, and the top-portion diagonal folding crease 37 of the side sealing panel 30, match with each other in the vertical direction. Further, when the inner panel 25 is horizontally folded along the bottom-portion horizontal folding crease 19 and is diagonally folded inward along the bottom-portion diagonal folding creases 27, flexing resistances at the bonded portions, which are applied to the bottom-portion horizontal folding crease 32 of the side sealing panel 30 and the bottom-portion diagonal folding crease 38 of the side sealing panel 30, match with each other in the vertical direction. Thus, a bending force is exerted in the same vertical direction. As a result, inward folding can easily be achieved under a stable state.

Other actions and effects are the same as those of the first example, and thus the description of the first example is used as the description of the actions and effects of the second example.

In the second example, the present invention is carried out for the liquid paper container having the gable top-type top portion. However, the present invention can also be carried out for a flat top-type liquid paper container.

REFERENCE SIGNS LIST

1A, 1B blank sheet
2, 3, 4 body vertical folding line
5, 6, 7, 8 body panel
9, 10 top-portion horizontal folding crease
11, 12 top panel
13, 14 top-portion horizontal folding crease
15, 16 side panel
17, 18 top-portion diagonal folding crease
19, 20 bottom-portion horizontal folding crease
21, 22 bottom panel
23, 24 bottom-portion horizontal folding crease
25, 26 inner panel
27, 28 bottom-portion diagonal folding crease
29 vertical folding crease at boundary of side sealing panel
30 side sealing panel
31 top-portion horizontal folding crease of side sealing panel
32 bottom-portion horizontal folding crease of side sealing panel
33 folding-crease absent portion
34 body
35 bottom portion
36 top portion
37 top-portion diagonal folding crease of side sealing panel
38 bottom-portion diagonal folding crease of side sealing panel
39, 40, 41, 42 sealing-portion horizontal folding crease
43, 44, 45, 46 sealing panel
47 sealing-portion horizontal folding crease of side sealing panel

The invention claimed is:

1. A liquid paper container, which is formed from a blank sheet made of a paper material having a thermoplastic resin laminated on each of a front surface and a back surface of the paper material, the blank sheet including:

four body panels, which are contiguous through body vertical folding creases;

a pair of top panels and a pair of side panels, which are respectively contiguous with upper ends of the body panels through top-portion horizontal folding creases so that the pair of top panels are opposed to each other and the pair of side panels are each positioned between the pair of top panels and are opposed to each other;

sealing panels, which are respectively contiguous with upper ends of the top panels and upper ends of the side panels through sealing-portion horizontal folding creases; and a pair of bottom panels and a pair of inner panels, which are respectively contiguous with lower ends of the body panels through bottom-portion horizontal folding creases so that the pair of bottom panels are opposed to each other and the pair of inner panels are each positioned between the pair of bottom panels and are opposed to each other, the liquid paper container comprising:

a side sealing panel, which is contiguous with a one-side open end edge of the blank sheet through a vertical folding crease at a boundary of the side sealing panel, the side sealing panel having a top-portion horizontal folding crease of the side sealing panel, which is to be overlapped with a corresponding one of the top-portion horizontal folding creases at a time of sealing, and a bottom-portion horizontal folding crease of the side sealing panel, which is to be overlapped with a corresponding one of the bottom-portion horizontal folding creases at the time of sealing, wherein the side sealing panel is sealed to an another-side open end edge of the blank sheet to form a body having a rectangular shape, wherein the pair of top panels and the pair of side panels are folded inward and the sealing panels are sealed to each other so as to be tightly closed to form a top portion, wherein the pair of bottom panels and the pair of inner panels are folded inward and sealed so as to be tightly closed to form a bottom portion, and wherein a plurality of folding-crease absent portions are provided midway along the top-portion horizontal folding crease of the side sealing panel, which is formed in the side sealing panel.

2. The liquid paper container according to claim 1, wherein one of the side panels for forming the top portion and one of the inner panels for forming the bottom portion are located on the another-side open end side of the blank sheet, wherein the side sealing panel has a top-portion diagonal folding crease of the side sealing panel, which is to be overlapped with a corresponding one of top-portion diagonal folding creases formed in the one side panel located on the another-side open end side of the blank sheet at the time of sealing, and wherein a plurality of folding-crease absent portions are provided midway along the top-portion diagonal folding crease of the side sealing panel.

3. The liquid paper container according to claim 2, wherein the side sealing panel has a sealing-portion horizontal folding crease of the side sealing panel, which is to be overlapped with a corresponding one of the sealing-portion horizontal folding creases at the time of sealing, and wherein a plurality of folding-crease absent portions are provided midway along the sealing-portion horizontal folding crease of the side sealing panel.

4. The liquid paper container according to claim 2, wherein a plurality of folding-crease absent portions are provided midway along the bottom-portion horizontal folding crease of the side sealing panel, which is formed in the side sealing panel.

5. The liquid paper container according to claim 2, wherein one of the side panels for forming the top portion and one of the inner panels for forming the bottom portion are located on the another-side open end side of the blank sheet, wherein the side sealing panel has a bottom-portion diagonal folding crease of the side sealing panel, which is to be overlapped with a corresponding one of bottom-portion diagonal folding creases formed in the one inner panel located on the another-side open end side of the blank sheet at the time of sealing, and wherein a plurality of folding-crease absent portions are provided midway along the bottom-portion diagonal folding crease of the side sealing panel.

6. The liquid paper container according to claim 2, wherein each of the folding-crease absent portions falls within a range of from 13% to 40% of a width of the side sealing panel.

7. The liquid paper container according to claim 1, wherein the side sealing panel has a sealing-portion horizontal folding crease of the side sealing panel, which is to be overlapped with a corresponding one of the sealing-portion horizontal folding creases at the time of sealing, and wherein a plurality of folding-crease absent portions are provided midway along the sealing-portion horizontal folding crease of the side sealing panel.

8. The liquid paper container according to claim 7, wherein a plurality of folding-crease absent portions are provided midway along the bottom-portion horizontal folding crease of the side sealing panel, which is formed in the side sealing panel.

9. The liquid paper container according to claim 7, wherein one of the side panels for forming the top portion and one of the inner panels for forming the bottom portion are located on the another-side open end side of the blank sheet, wherein the side sealing panel has a bottom-portion diagonal folding crease of the side sealing panel, which is to be overlapped with a corresponding one of bottom-portion diagonal folding creases formed in the one inner panel located on the another-side open end side of the blank sheet at the time of sealing, and wherein a plurality of folding-crease absent portions are provided midway along the bottom-portion diagonal folding crease of the side sealing panel.

10. The liquid paper container according to claim 7, wherein each of the folding-crease absent portions falls within a range of from 13% to 40% of a width of the side sealing panel.

11. The liquid paper container according to claim 1, wherein a plurality of folding-crease absent portions are provided midway along the bottom-portion horizontal folding crease of the side sealing panel, which is formed in the side sealing panel.

12. The liquid paper container according to claim 11, wherein one of the side panels for forming the top portion and one of the inner panels for forming the bottom portion are located on the another-side open end side of the blank sheet, wherein the side sealing panel has a bottom-portion diagonal folding crease of the side sealing panel, which is to be overlapped with a corresponding one of bottom-portion diagonal folding creases formed in the one inner panel located on the another-side open end side of the blank sheet at the time of sealing, and wherein a plurality of folding-crease absent portions are provided midway along the bottom-portion diagonal folding crease of the side sealing panel.

13. The liquid paper container according to claim 1, wherein one of the side panels for forming the top portion and one of the inner panels for forming the bottom portion are located on the another-side open end side of the blank sheet, wherein the side sealing panel has a bottom-portion diagonal folding crease of the side sealing panel, which is to be overlapped with a corresponding one of bottom-portion diagonal folding creases formed in the one inner panel located on the another-side open end side of the blank sheet at the time of sealing, and wherein a plurality of folding-crease absent portions are provided midway along the bottom-portion diagonal folding crease of the side sealing panel.

14. The liquid paper container according to claim 1, wherein each of the folding-crease absent portions falls within a range of from 13% to 40% of a width of the side sealing panel.

15. The liquid paper container according to claim 1, wherein each of the folding-crease absent portions falls within a range of from 13% to 40% of a width of the side sealing panel.

* * * * *